US006066297A

United States Patent [19]

Torti et al.

[11] Patent Number: 6,066,297

[45] Date of Patent: May 23, 2000

[54] SMALL SAMPLE VOLUME DISPLACEMENT PIPETTE TIPS

[75] Inventors: Victor A. Torti, Brookline, N.H.; Robert H. Zier, Annapolis, Md.; Jean-Paul G. Boucher, Nashua, N.H.

[73] Assignee: Matrix Technologies Corporation, Hudson, N.H.

[21] Appl. No.: 08/778,664

[22] Filed: Jan. 3, 1997

[51] Int. Cl.[7] ..... B01L 3/02

[52] U.S. Cl. ..... 422/100; 422/104; 73/864.01; 73/863.32

[58] Field of Search ..... 422/100, 104; 73/864.01, 863.32

[56] References Cited

U.S. PATENT DOCUMENTS

| | | | |
|---|---|---|---|
| D. 282,208 | 1/1986 | Lowry | D24/55 |
| D. 384,418 | 9/1997 | Torti et al. | D24/222 |
| 3,757,585 | 9/1973 | Heller et al. | 73/425.6 |
| 3,933,048 | 1/1976 | Scordato | 73/425.6 |
| 4,349,109 | 9/1982 | Scordato et al. | 206/562 |
| 4,567,780 | 2/1986 | Oppenlandes et al. | 73/864.16 |
| 4,707,337 | 11/1987 | Jeffs et al. | 422/100 |
| 4,824,641 | 4/1989 | Williams | 422/100 |
| 4,933,148 | 6/1990 | Perlman | 422/100 |
| 4,999,164 | 3/1991 | Puchinger et al. | 422/100 |
| 5,092,184 | 3/1992 | Goodell et al. | 73/863.32 |
| 5,200,151 | 4/1993 | Long | 422/100 |
| 5,218,875 | 6/1993 | Volpe et al. | 73/864.01 |
| 5,223,225 | 6/1993 | Gautsch | 422/100 |
| 5,232,669 | 8/1993 | Pardinas | 422/100 |
| 5,236,666 | 8/1993 | Hulette et al. | 422/65 |
| 5,260,030 | 11/1993 | DeVaughn | 422/100 |
| 5,364,595 | 11/1994 | Smith | 422/100 |
| 5,456,879 | 10/1995 | Suovaniemi | 422/100 |
| 5,470,538 | 11/1995 | Lind | 422/104 |
| 5,487,997 | 1/1996 | Stolp | 436/54 |
| 5,642,816 | 7/1997 | Kelly et al. | 211/60.1 |
| 5,779,984 | 7/1998 | Kelly et al. | 422/104 |
| 5,807,524 | 9/1998 | Kelly et al. | 422/100 |

FOREIGN PATENT DOCUMENTS

| | | |
|---|---|---|
| 0 562 358 A2 | 9/1993 | European Pat. Off. . |
| 2 172 218 | 9/1986 | United Kingdom . |

OTHER PUBLICATIONS

Eppendorf flyer, p. 12.
Rainin Instrument Co., Inc., catalog sheet, pp. 5–6.
Eppendorf flyer, 2 pages.

*Primary Examiner*—Arlen Soderquist
*Attorney, Agent, or Firm*—Wolf, Greenfield & Sacks, P.C.

[57] ABSTRACT

A pipette tip with a volume capacity of at least about 1250 μl that can be used with single channel or multichannel pippetors and that can be used effectively with microtiter tubes, test tubes and microtiter plates. The tip can be a single contiguous piece, typically formed of a material such as polypropylene. The total length of the pipette tip is about 4.0 inches. The tip includes a stem, a head and a midsection disposed between the stem and the head. The tip also includes a passageway that extends longitudinally through the head, the midsection and the stem.

14 Claims, 3 Drawing Sheets

SMALL SAMPLE VOLUME DISPLACEMENT PIPETTE TIPS

BACKGROUND

1. Technical Field

The present invention generally relates to pipette tips that displace relatively small volumes of liquid sample during pipetting such that the tips may be used in single channel or multichannel applications, and more specifically to such pipette tips that have relatively large volume capacities.

2. Discussion of the Prior Art

Pipette tips have been used to manipulate liquid samples for decades. Generally, the particular design and dimensions of a pipette tip depend upon the intended use of the pipette tip. For example, a pipette tip fabricated for pipetting small volumes of liquids may be designed to have minimal interior dead air space while a pipette tip fabricated for use with filters may have a large interior dead air space. In certain circumstances, it is desirable to provide a pipette tip that may be used with conventional microtiter tubes, standard sized test tubes and microtiter plates. However, pipetting operations conducted with microtiter tubes and test tubes are normally carried out using single channel pippetors while pipetting activities conducted with microtiter plates are typically performed using multichannel pipettors. Thus, a pipette tip that is designed for use with microtiter tubes, test tubes and microtiter plates should be compatible with both single channel pipettors or multichannel pipettors.

Pipette tips designed for pipetting large volumes of liquid (i.e., volumes greater than about 625 $\mu$L) are commercially available in a variety of designs. FIG. 1 is representative of one such pipette tip 10 that is designed for use in single channel or multichannel applications with commercial pipettors, such the as Impact®, Impact2®, Micronic® and/or Electrapette® pipettors (each a registered trademark of Matrix Technologies Corporation, located in Lowell, Mass.).

Prior art tip 10 is a unitary molded piece having a head 12, a midsection 14 and a stem 16. Tip 10 further includes a passageway 18 which extends longitudinally from opening 20, passing entirely through tip 10 and terminating at orifice 22. Tip 10 is designed such that the volume of opening 18 is about 1250 $\mu$L. Therefore, the maximum outer diameter and length of midsection 14 are about 0.24 inches and about 1.2 inches, respectively, and the maximum outer diameter and length of stem 16 are about 0.24 inches and about 0.75 inches, respectively. In addition, the maximum inner diameter of orifice 22 is about 0.05 inches.

While tip 10 may operate adequately with microtiter plates, FIGS. 2 and 3 show tip 10 partially disposed within a conventional microtiter tube 24 and a standard sized test tube 23, respectively. Microtiter tube 24 has a length of about 1.7 inches and an inner diameter of about 0.27 inches, and test tube 23 has a length of about 3.9 inches and an inner diameter of about 0.5 inches. Tip 10 may be capable of accessing the bottom of microtiter tube 24, but the comparatively large combined volume of midsection 14 and stem 16 results in a substantial amount of liquid sample being displaced as the sample is pipetted from microtiter tube 24. This excessive sample displacement during use with microtiter tubes is disadvantageous because it results in sample loss and possible cross-contamination between samples. Furthermore, although tip 10 may not displace an excessive amount of sample volume from test tube 23, tip 10 is unable to access the bottom of tube 23. Hence, tip 10 cannot be used effectively with certain conventional microtiter tubes and standard sized test tubes.

While holding the volume capacity of tip 10 constant at about 1250 microliters, the sample displacement caused by tip 10 can be reduced by decreasing the combined volume of midsection 14 and stem 16 while keeping the volume of opening 18 constant. This may be achieved by increasing the length of stem 16, which would also allow tip 10 to access the bottom of test tube 23. However, if stem 16 is too long, it may not remain straight, compromising the accuracy of tip 10. Moreover, in certain cases, it may be advantageous for a technician using tip 10 to have control of droplets formed at orifice 22, such as when "touching off," a procedure in which the technician removes the droplets from orifice 22. However, increasing the length of stem 16 can reduce the control a technician may have over these droplets. Also, if stem 16 is too long, an operator may generally lose control of tip 10, causing the operator to use two hands to steady tip 10. Therefore, the length of stem 16 cannot be increased to an arbitrarily high value. Furthermore, tip 10 should be capable of housing a filter to reduce aerosol contamination and/or to prevent the liquid sample from entering the pipettor. Such a filter is typically contained within midsection 14, so the volume of midsection 14 cannot be reduced below the volume of the filter. In addition, to improve the accuracy of tip 10 by minimizing droplet formation at orifice 22, the maximum inner diameter of orifice 22 should be minimized. Thus, a careful balance of a variety of the dimensions of a pipette tip must be reached to provide a pipette tip with a volume of about 1250 $\mu$L that is compatible with microtiter tubes, test tubes and microtiter plates.

Presently, it remains a challenge in the art to provide such a pipette tip. Furthermore, due to the delicate balance of parameters involved as described above, when preparing this pipette tip, one skilled in the art would not simply look to the many different available pipette tip designs that are known and select particular dimensions from these pipette tips in an ad hoc fashion.

SUMMARY

In one illustrative embodiment, a pipette tip has a length of about 4.0 inches. The tip includes a stem, a head and a midsection disposed between the stem and the head. The tip also includes an opening that extends continuously through the head, the midsection and the stem. The volume of the opening is at least about 1250 $\mu$L.

In another illustrative embodiment, a pipette tip includes a stem, a head and a midsection disposed between the stem and the head. The tip also includes an opening that extends continuously through the head, the midsection and the stem. The volume of the opening is at least about 1250 $\mu$L, and the angle between the centerline of the opening and the stem is about 2.6°.

In yet another illustrative embodiment, a pipette tip includes a stem, a head and a midsection disposed between the stem and the head. The length of the midsection is about 0.8 inches. The tip also includes an opening that extends continuously through the head, the midsection and the stem. The volume of the opening is at least about 1250 $\mu$L.

In a further illustrative embodiment, a pipette tip includes a stem, a head and a midsection disposed between the stem and the head. The stem has a length of about 2.1 inches. The tip also includes an opening that extends continuously through the head, the midsection and the stem. The volume of the opening is at least about 1250 $\mu$L.

In still a further illustrative embodiment, a pipette tip is configured and arranged to be used with a microtiter tube, a test tube or microtiter plate. The tip has a length of about 4.0 inches. The tip includes a stem, a head and a midsection disposed between the stem and the head. The stem has a length of about 2.1 inches. The tip also includes an opening that extends continuously through the head, the midsection and the stem.

In yet a further illustrative embodiment, a pipette tip is configured and arranged to be used with a microtiter tube, a test tube or microtiter plate. The tip has a length of about 4.0 inches. The tip includes a stem, a head and a midsection disposed between the stem and the head. The midsection has a length of about 0.8 inches. The tip also includes an opening that extends continuously through the head, the midsection and the stem.

DETAILED DESCRIPTION

Figure 1:
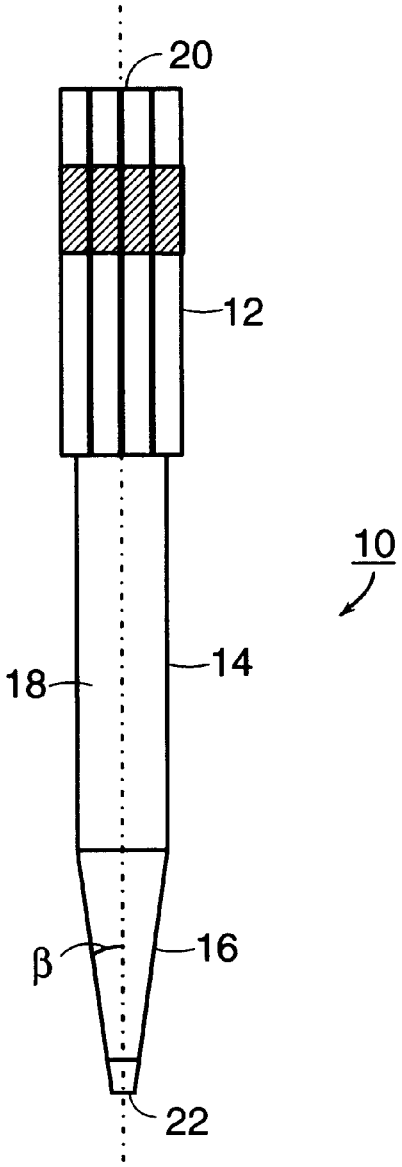
FIG. 1 PRIOR ART
FIG. 1 is a cross-sectional view of a pipette tip according to the prior art.
Figure 2:
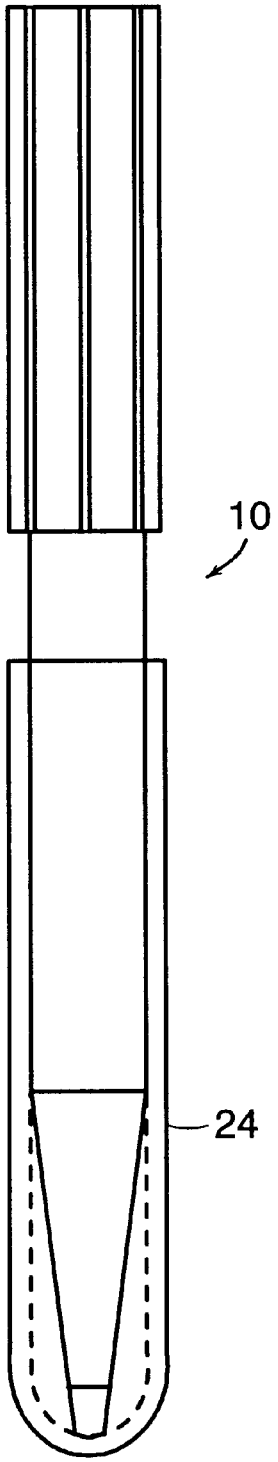
FIG. 2 PRIOR ART
FIG. 2 is a cross-sectional view of a pipette tip according to the prior art partially disposed within a conventional microtiter tube.
Figure 3:
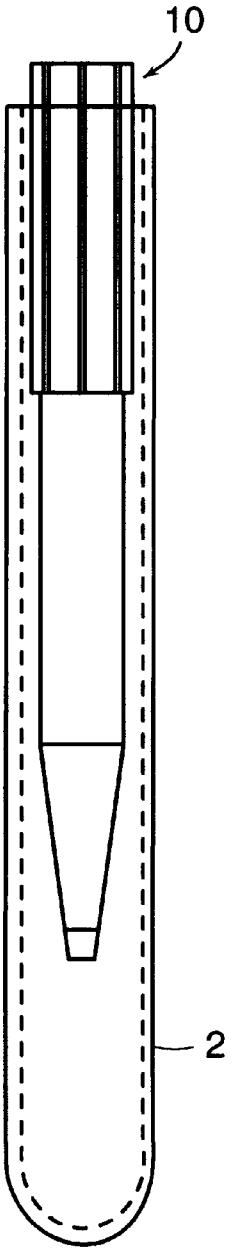
FIG. 3 PRIOR ART
FIG. 3 is a cross-sectional view of a pipette tip according to the prior art partially disposed within a standard test tube.
Figure 4:
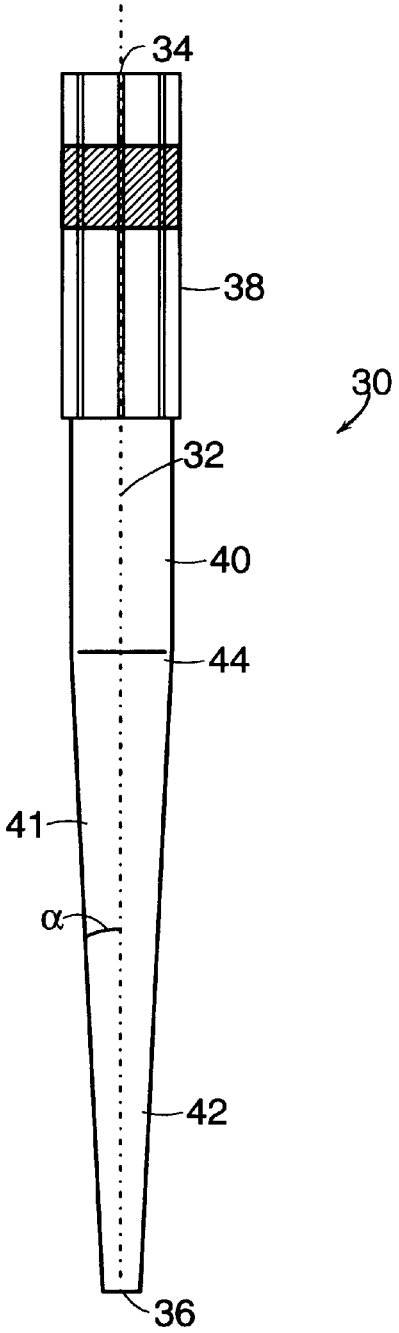
FIG. 4 is a cross-sectional view of a pipette tip according to one embodiment of the present invention.

FIG. 4 shows a pipette tip 30 designed to hold a sample volume of about 1250 $\mu$L while providing decreased sample displacement during pipetting from certain liquid sample containers, such as certain conventional microtiter tubes, and while also being able to reach the bottom of standard sized test tubes, as described in greater detail herein below. Tip 30 may preferably be a contiguous piece having a head 38, a midsection 40 and a stem 42. Preferably, tip 30 may be a unitary molded piece formed of a polymeric material, such as polypropylene. Other materials appropriate for use in constructing tip 30 are known to those skilled in the art and may be substituted for polypropylene.

Tip 30 also includes a passageway 32 which extends longitudinally within tip 30 and provides fluid communication between opening 34 and orifice 36. To allow tip 30 to be used in pippeting with decreased sample displacement while being able to reach the bottom of liquid sample containers, the diameter of passageway 32 generally decreases from orifice 34 to orifice 36. In particular, below a transition point 44 which is disposed between midsection 40 and stem 42, the diameter of passageway 32 preferably decreases at a relatively sharp rate to reduce the amount of liquid sample displaced by tip 30 by minimizing the outside diameter of stem 42. In the present embodiment, the diameter of tip 30 at transition point 44 is about 0.25 inches. To allow tip 30 to pipette large volumes of liquid sample, passageway 32 should have a volume of greater than about 625 $\mu$l. Preferably, passageway 32 has a volume of from about 1250 $\mu$L to about 1550 $\mu$L and more preferably about 1250 $\mu$L.

Figure 5:
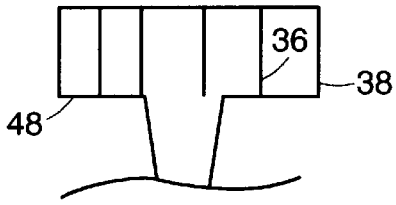
FIG. 5 is a side elevational view of the head of a pipette tip according to the embodiment of FIG. 4.

Head 38 is preferably designed to be compatible with industry standard single channel and multichannel pipettors, such as the Impact®, Impact2®, Micronic® and/or Electrapette® pipettors, although other commercially available pipettors will be readily known to one of skill in the art Thus, in the present embodiment, the outer diameter of head 38 is restrained to values less than the distance between the centers of adjacent wells in industry standard microtiter plates. Furthermore, head 38 preferably includes a shoulder 48 that allows tip 30 to be stored in industry standard pipette tip racks, thereby limiting the length of head 38. To achieve compatibility with single channel pipettors and multichannel pipettors, head 38 may preferably have an outer diameter of about 0.35 inches and a length of about 1.1 inches. As shown in FIG. 5, in some embodiments, head 38 may include vertical ribs 36 to facilitate manual handling of tip 30.

To reduce the amount of liquid sample displaced by tip 30 during pipetting, midsection 40 preferably has a reduced length relative to midsection 20 of prior art tip 10. Specifically, while the length of prior art midsection 14 is about 1.2 inches, midsection 40 preferably has a length of less than about 1.2 inches, more preferably about 0.8 inches, although midsection 40 may be shorter and still reach the bottom of many standard sized test tubes. The minimum outer diameter of midsection 40 is about 0.25 inches to allow that tip 30 may house a filter designed to reduce aerosol contamination during successive fillings of tip 30 and/or to prevent liquid from entering a pipette from tip 30 when the liquid is subjected to turbulence as the pipette is being handled.

The combined volume of stem 42 and midsection 40 may preferably be reduced by increasing the length of stem 42 and decreasing the angle, $\alpha$, between the centerline of passageway 32 and the sidewall 41 of stem 42. However, the length of stem 42 should preferably be short enough to keep stem 42 straight. Furthermore, the volume of passageway 32 should be within the above-noted ranges. Therefore, stem 42 preferably has a length of greater than about 0.75 inches and more preferably about 2.1 inches. In prior art tip 10, the angle, $\beta$, between the centerline of opening passageway 18 and the sidewall of stem 16 is about 6.8°. In contrast, however, the angle, $\alpha$, of tip 30 is preferably about 2.6°.

With the aforementioned dimensional values for head 38, midsection 40 and stem 42, tip 30 offers the desirable feature of being flexible enough to remove liquid droplets at orifice 36 while pipetting and manipulating samples with tip 30. This procedure, generally referred to as "touching off", is frequently performed when incrementally pipetting liquid samples. To assist in allowing tip 30 to "touch off" and to minimize liquid sample loss, orifice 36 should preferably have a smaller diameter than orifice 22 of tip 10. However, if the diameter of orifice 36 is too small, a back pressure will form which reduces the ability of tip 30 to form small droplets and results in decreased accuracy of tip 30. Accordingly, orifice 36 preferably has a maximum inner diameter of about 0.03 inches.

Figure 6:
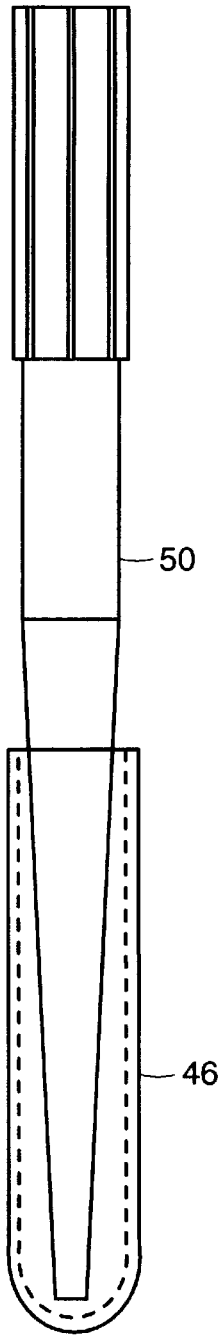
FIG. 6 is a cross-sectional view of a pipette tip according to the embodiment of FIG. 4 partially disposed within a conventional microtiter tube.

In use, a technician would select a 1250 $\mu$L pipette tip conforming to the above dimensional configurations, such as tip 50 illustrated in FIG. 6. Tip 50 has: a total length of about 4.0 inches; a head with an outer diameter of 0.35 inches and a length of 1.1 inches; a midsection with a maximum outer diameter of 0.25 inches and a length of 0.8 inches; a stem with a length of about 2.1 inches, a maximum diameter of about 0.25 inches, an angle $\alpha$ of about 2.6° and an orifice with a maximum inner diameter of about 0.03 inches. The technician would then place the tip on either a single or multichannel pipette and would procede to pipette. As shown in FIG. 6, when utilizing tip 50 within a microtiter tube the tip advantageously does not cause substantial liquid displacement and, therefore, liquid is not lost from tube 46. Thus, while tip 50 and tip 10 each have a sample volume capacity of about 1250 μl, tip 50 displaces a substantially smaller sample volume than tip 10.

Figure 7:
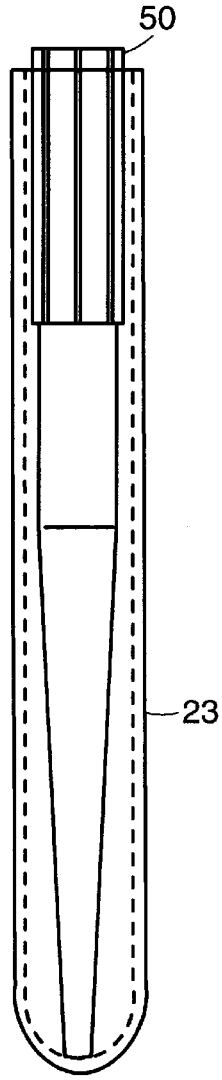
FIG. 7 is a cross-sectional view of a pipette tip according to the embodiment of FIG. 4 partially disposed within a standard sized test tube.

FIG. 7 shows that, in contrast to prior art tip 10, tip 50 may also be advantageously used within standard sized test tube 23, where the tip is able to reach the bottom of test tube 23 thereby allowing accurate pipetting of an entire liquid sample from test tube 23.

Having thus described certain embodiments, various alterations, modifications and improvements will be apparent to those skilled in the art. For example, head 38 may optionally be provided without vertical ribs 36, but may have an alternate configuration to facilitate handling of tip 30. Such modifications, alterations and improvements are intended to be within the scope and spirit of the present invention. Accordingly, the present invention is only limited as defined by the appended claims and the equivalents thereto.

What is claimed is:

1. A pipette tip, comprising:

a stem, a head, a midsection disposed between the stem and the head, and a passageway extending longitudinally through the head, the midsection and the stem, the length of the pipette tip being about 4.0 inches, and the midsection having a substantially cylindrical shape and a length ranging from about 0.8 inches to about 1.2 inches;

wherein the pipette tip is dimensioned and configured to access a bottom of a test tube and to reduce sample loss when used with a microtiter test tube and a microtiter test plate.

2. The pipette tip according to claim 1, wherein the stem has a length ranging from about 0.75 inches to about 2.1 inches.

3. The pipette tip according to claim 2, wherein the stem has a length of about 2.1 inches and the passageway has a volume of at least about 1250 μL.

4. The pipette tip according to claim 3, wherein an angle between a centerline of the passageway and a sidewall of the stem is about 2.6°.

5. The pipette tip according to claim 1, wherein the passageway has a volume ranging from about 625 μL to about 1550 μL.

6. The pipette tip according to claim 5, wherein an angle between a centerline of the passageway and a sidewall of the stem is about 2.6°.

7. A pipette tip, comprising:

a head, a stem, a midsection disposed between the head and the stem, and a passageway extending longitudinally through the head, the midsection and the stem, the midsection having a length of about 0.8 inches and a substantially cylindrical shape, the stem having a length of about 2.1 inches, and an angle between a centerline of the passageway and a sidewall of the stem being about 2.6°;

wherein the pipette tip is dimensioned and configured to access a bottom of a test tube and to reduce sample loss when used with a microtiter test tube or microtiter test plate.

8. A pipette tip, comprising:

a head, a stem, a midsection disposed between the head and the stem, and a passageway continuously extending through the head, the midsection and the stem, the pipette tip having a length of about 4.0 inches, the midsection having a length of about 0.8 inches and a substantially cylindrical shape, the stem having a length of about 2.1 inches, the passageway having a volume of at least about 1250 μl, and an angle between a centerline of the passageway and a sidewall of the stem being about 2.6°;

wherein the pipette tip is dimensioned and configured to access a bottom of a test tube and to reduce sample loss when used with a microtiter test tube or microtiter test plate.

9. A pipette tip, comprising:

a head, a stem, a midsection disposed between the head and the stem, and a passageway continuously extending through the head, the midsection and the stem, the pipette tip having a length of about 4.0 inches, the midsection having a length ranging from about 0.8 inches to about 1.2 inches, the stem having a length of about 2.1 inches, the passageway having a volume ranging from about 625 μL to about 1550 μL, and an angle between a centerline of the passageway and a sidewall of the stem being about 2.6°;

wherein the pipette tip is dimensioned and configured to access a bottom of a test tube and to reduce sample loss when used with a microtiter test tube or a microtiter test plate.

10. The apparatus of claim 9, further comprising an orifice disposed at the end of the stem, the orifice having a diameter of less than about 0.03 inches.

11. The apparatus of claim 9, the midsection and the stem defining a transition point, the inner diameter of the transition point being about 0.25 inches.

12. A method of pipetting, comprising:

selecting a pipette tip having a head, a stem, a midsection, and a passageway extending continuously through the head, the midsection, and the stem, the stem having a length of about 2.1 inches, the midsection having a length ranging from about 0.8 inches to about 1.2 inches, the passageway having a volume ranging from about 1250 μL to about 1550 μL, an angle between a centerline of the passageway and a sidewall of the stem being about 2.6°, the pipette tip having a length of about 4.0 inches, the pipette tip being dimensioned and configured to access a bottom of a test tube and to reduce sample loss when used with a microtiter test tube and a microtiter test plate;

attaching the pipette tip to a pipettor; and selectively actuating the pipettor to remove a fluid sample from one of a microtiter test tube, a microtiter test plate, and a test tube.

13. The method of claim 12, wherein the pipettor is a single channel pipettor.

14. The method of claim 12, wherein the pipettor is a multi-channel pipettor.

* * * * *